United States Patent [19]

Thomas

[11] Patent Number: 5,025,639

[45] Date of Patent: Jun. 25, 1991

[54] PATIO COOLER TABLE

[76] Inventor: Tammy D. Thomas, 1240 Riti La., Granite City, Ill. 62040

[21] Appl. No.: 365,002

[22] Filed: Jun. 12, 1989

[51] Int. Cl.[5] ..... F25D 23/13

[52] U.S. Cl. ..... 62/258; 62/458; 62/464

[58] Field of Search ..... 62/258, 261, 458, 463, 62/464; 108/25; 312/281

[56] References Cited

U.S. PATENT DOCUMENTS

| | | | |
|---|---|---|---|
| 161,694 | 4/1875 | Libert | 62/258 X |
| 1,351,097 | 8/1920 | Cook . | |
| 1,412,198 | 4/1922 | Ryediger | 62/464 X |
| 2,727,366 | 12/1955 | Hagen | 62/261 X |
| 2,895,311 | 7/1959 | Spalvins | 62/458 X |
| 3,364,882 | 1/1968 | Merrick | 108/50 |
| 4,023,379 | 5/1977 | Zevlakis | 62/258 |
| 4,122,780 | 10/1978 | Brickman | 108/25 |
| 4,400,951 | 8/1983 | Cherry | 62/258 |
| 4,437,714 | 3/1984 | Struck | 108/25 |
| 4,625,655 | 12/1986 | Brickman | 108/25 |
| 4,625,656 | 12/1986 | Brickman | 108/25 |
| 4,848,091 | 7/1989 | Border | 62/258 X |

*Primary Examiner*—Lloyd L. King

*Attorney, Agent, or Firm*—Andsel Group

[57] ABSTRACT

A patio table has a means for supporting an umbrella, incorporating a central thermally insulated container having access doors or the top surface of the table. The thermal container is cooled by an enclosure containing ice/chemical coolant or alternate refrigeration coils. A tubular member extends from the table top to a base structure of expanded area. The base structure has an enclosure for an alternate electric refrigeration unit.

1 Claim, 1 Drawing Sheet

PATIO COOLER TABLE

BACKGROUND OF THE INVENTION

1. Field of the Invention

The instant invention relates to patio tables with a cooling receptacle for food and beverages occupying the center section of the table.

2. Description of the Prior Art

The prior art describes several tables having cooling receptacles mounted in the center or on the top portion of the table. U.S. Pat. No. 1,351,097 Cook, discloses a combination refrigerator and table. Refrigeration being furnished by an ice chamber. U.S. Pat. No. 3,364,882 Mervick, discloses a leaf-type table wherein an ice cooled beverage container is used in lieu of the center leaf. U.S. Pat. No. 4,122,780 Brickman discloses a foldable bar table with openings in the top surface to enable containers to be inserted therethrough.

SUMMARY OF THE INVENTION

The instant invention describes a conventional patio table constructed of plastic, rattan, metal or the like wherein the center section comprises a thermally insulated container cooled by ice, a chemical coolant, or an electric refrigeration unit. A reinforced tubular section in the center of the container has a means for supporting the center pole of an umbrella. A hinged door on either side of the center pole support provides access to the center container from either side of the table.

DETAILED DESCRIPTION OF THE PREFERRED EMBODIMENTS

Figure 1:
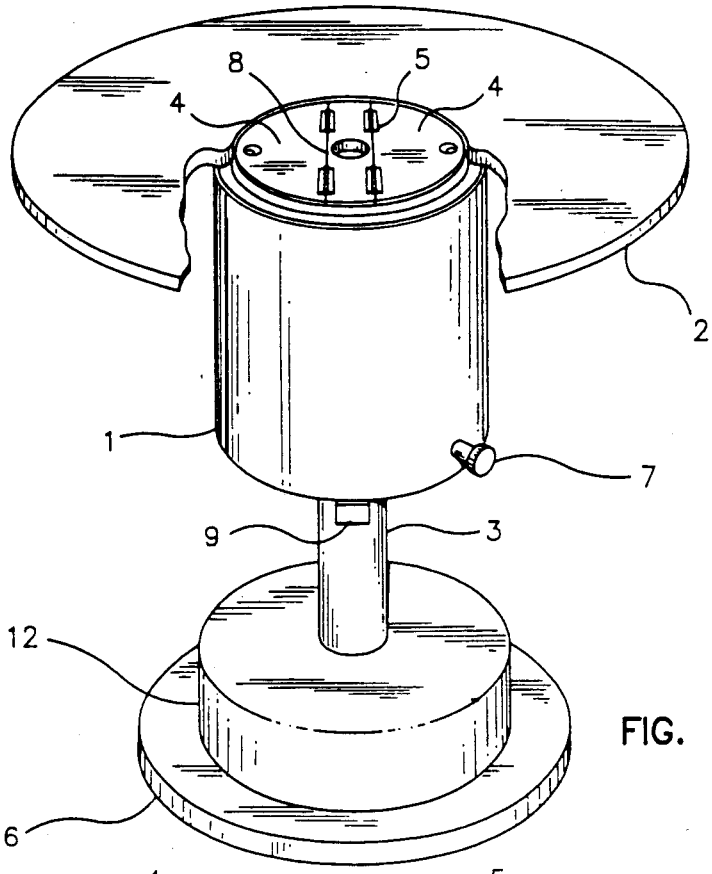
FIG. 1 is a top front partially sectioned perspective view of the patio cooler table.

In FIG. 1 the table top 2 is shown supported by tubular center post 3 extends downward to circular base support 6, radial structure members 8 and 9 and central thermally insulated container 1. Top access doors 4 supported by hinge 5 to radial member 8. The drain plug 7 on the bottom of container 1 provides drainage access to the container 11.

Figure 2:
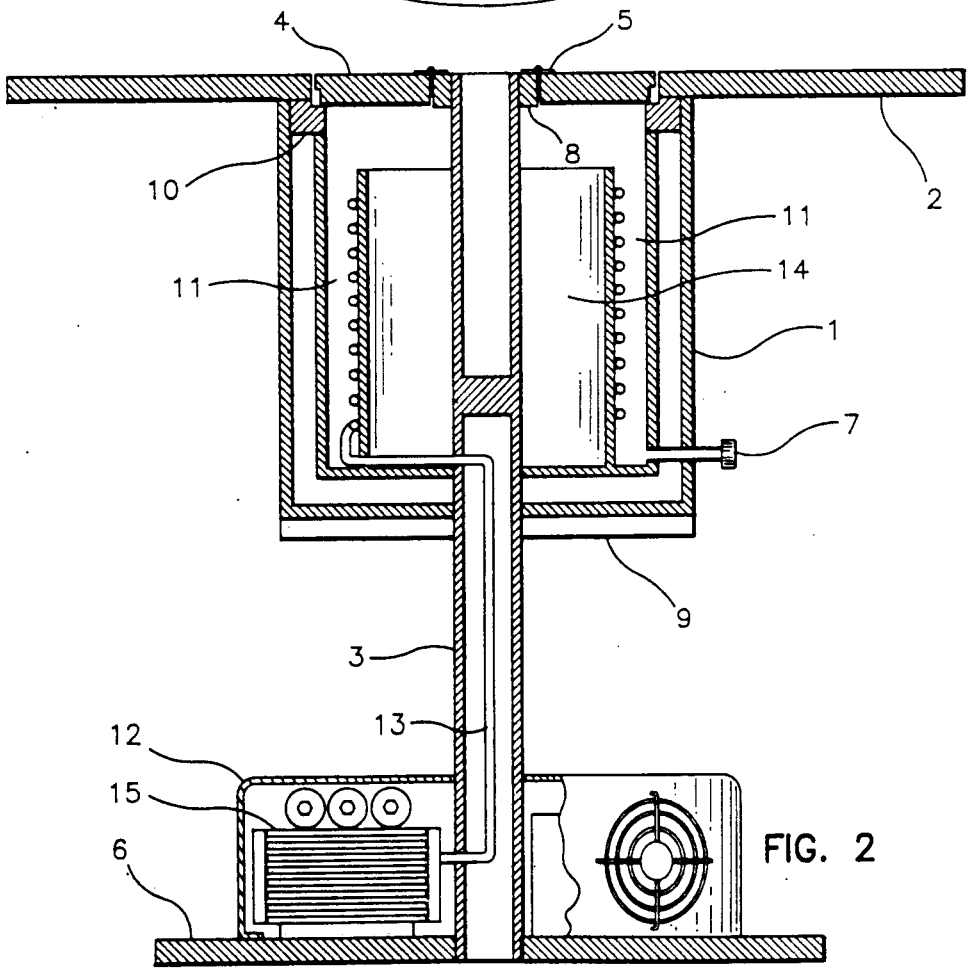
FIG. 2 is a sectional front end view of the patio cooler table.

The sectional veiw of FIG. 2 shows the table top 2, the tubular support 3, the radial structural members 8 and 9, the access doors 4 attached to hinge 5 and the circumferential support member 10 for the container 1. The thermally insulated metal or plastic and fiberglass container 1 having an inner ventilated receptacle 11 for ice, chemical coolant or the refrigerating coils 13 from the alternate refrigerator unit 15 mounted on the base structure 6. A drain plug 7 for cleaning and draining the container 11 is shown on the bottom of the container. The coil 13 extends from the refrigeration unit 15, located in space 12, upward along the center post, as shown in FIG. 2, and wraps around container 14 and cools container 14.

I claim:

1. A patio table constructed of plastic or metal having a central refrigerated container accessible from the top wherein the improvement comprises:

(a) the table supported by a central vertical support tubular member;

(b) the top of the tubular member having means for supporting an umbrella post;

(c) the bottom of the tubular member attached to a base structure of extended area;

(d) the base structure including an enclosure for the alternate case of an electric refrigeration unit;

(e) support members extending radially from the tubular member supporting a circular, thermally insulated container;

(f) a second, container circumferential, ventilated, adjacent to and axially centered in the insulated container;

(g) the second container enclosing ice, chemical cooling materials or alternately refrigerating coils;

(h) two access doors on the top surface of the insulated container hinged to the radial support structure.

* * * * *